US006952901B2

(12) United States Patent
Jacques et al.

(10) Patent No.: US 6,952,901 B2
(45) Date of Patent: Oct. 11, 2005

(54) PANEL MOUNTED SHINGLES ASSEMBLY WITH VENTILATING SCREEN

(75) Inventors: Donald Jacques, St-Pamphile (CA); Raynald Mercier, Ste-Perpétue-de-L'Islet (CA); Germain Morin, St-Phamphile (CA)

(73) Assignee: Les Industries Maibec Inc., Sto-Foy (CA)

( * ) Notice: Subject to any disclaimer, the term of this patent is extended or adjusted under 35 U.S.C. 154(b) by 0 days.

(21) Appl. No.: 10/365,545

(22) Filed: Jan. 31, 2003

(65) Prior Publication Data

US 2004/0148884 A1 Aug. 5, 2004

(51) Int. Cl.[7] ..... E04B 7/02

(52) U.S. Cl. ..... 52/302.1; 52/555; 52/547; 52/302.1

(58) Field of Search ..... 52/314, 311.2, 52/555, 592.1, 520, 539, 547, 302.1, 543

(56) References Cited

U.S. PATENT DOCUMENTS

| | | | | | |
|---|---|---|---|---|---|
| 2,384,686 | A | * | 9/1945 | Kraus | 52/540 |
| 3,305,994 | A | * | 2/1967 | Amrhein et al. | 52/489.2 |
| 4,050,209 | A | | 9/1977 | Barker et al. | |
| 4,107,885 | A | * | 8/1978 | Lindal | 52/91.1 |
| 4,345,630 | A | | 8/1982 | Bockwinkel et al. | |
| 4,459,788 | A | | 7/1984 | Bockwinkel et al. | |
| 4,499,701 | A | | 2/1985 | Bockwinkel et al. | |
| 4,586,309 | A | | 5/1986 | Ferguson | |
| 5,040,348 | A | * | 8/1991 | King et al. | 52/533 |
| 5,249,402 | A | * | 10/1993 | Crick et al. | 52/533 |
| 5,433,050 | A | * | 7/1995 | Wilson et al. | 52/302.1 |
| 6,023,906 | A | * | 2/2000 | Folkersen | 52/746.11 |
| 6,122,877 | A | * | 9/2000 | Hendrickson et al. | 52/520 |
| 6,151,855 | A | * | 11/2000 | Campbell | 52/408 |

FOREIGN PATENT DOCUMENTS

| | | |
|---|---|---|
| CA | 298017 | 4/1930 |
| CA | 0552485 | 2/1958 |
| CA | 1171629 | 7/1984 |
| CA | 2339342 | 4/1994 |

OTHER PUBLICATIONS

Publicity brochure Home Slicker May 1, 2002.
Cedar Valley Shingle Systems (Spec.) 1999.
Shakertown Co. Sidewall panel spec. Aug. 2002.
Publicity brochure The Panel Maibec Aug. 2002.
Benjamin Obdyke Cedar Breather published on Jan. 23, 1995.
Benjamin Obdyke Cedar Breather Copyright 2002.

* cited by examiner

*Primary Examiner*—Carl D. Friedman
*Assistant Examiner*—Basil Katcheves
(74) *Attorney, Agent, or Firm*—Francois Martineau

(57) ABSTRACT

An exterior weather shielding panel assembly for fitting against an external side wall of a building, comprising a rigid back board for anchoring engagement with the building side wall, a waterproofing membrane applied against the back board, an air ventilating screen applied against the waterproofing membrane opposite the back board, and a plurality of shingles disposed against the screen outer face in slopewisely cascading fashion. Nails concealed by the overlapping sections of upper rows of shingles fixedly anchor the panel assembly components to the residential building side wall. The panel assembly is manufactured in factory before installation on the building.

20 Claims, 5 Drawing Sheets

PANEL MOUNTED SHINGLES ASSEMBLY WITH VENTILATING SCREEN

FIELD OF THE INVENTION

This invention relates to external wall coverings for buildings.

BACKGROUND OF THE INVENTION

In residential buildings, external side walls may be made from a variety of materials. Bricks or stone walls are common. However, in some historical districts of cities, standards may be set for compulsory wooden side walls. Wooden side-wall shingles are then recommended, to facilitate withstanding of weathering forces. A water barrier membrane is typically installed against the building side wall, and then the shingles are installed one by one by semi-skilled workers standing outside the building. This is labour intensive and does not enable perfect waterproofness of installation. The shingles may be offset or tilted relative to one another, providing an odd or unbalanced view. Some moisture can become undesirably trapped between the water barrier membrane and the shingles, thus compromising the useful lifetime of the shingles, especially if keyway slots extend between each pair of successive shingle from a given horizontal row of shingles.

As an alternate mode of installation, a number of similarly sized shingles may be factory installed to the water barrier membrane and associated plywood board, and then shipped as an integral module to the construction site. This multiple shingles module may be installed directly against the building side wall, adjacent another shingles module, and then interlocked to one another about an edgewise joint. However, such shingles modules are still damaged quite rapidly by weathering forces, and are thus short lasting in useful lifetime due to moisture borne loads. The reason for such inefficiency is that the layer of shingles is not per se waterproof, since a number of water seeping gaps exist along this first "line of defense" of the side wall. Hence, some water from rain, snow or the like is allowed to seep in between shingles, to become trapped between the water barrier membrane and the shingles. This trapped moisture is what is deleterious to the useful life time of the shingles.

OBJECTS OF THE INVENTION

The gist of the present invention is to improve the useful lifetime of shingle panel assemblies for building external walls.

A corollary object of this invention is to improve waterproofness of such shingle panel assemblies.

Another object of the present invention is to improve upon the stability of such a shingle assembly by reducing the likelihood of swelling of the shingle assembly components generated by unvented moisture therebehind.

An object of the present invention is to provide a building external wall shingles and backing board assembly having no exposed nailing.

A general object of this invention is to improve upon residential sidewalls ventilation.

SUMMARY OF THE INVENTION

In accordance with the objects of the invention, there is disclosed an exterior weather shielding panel assembly for fitting against an external wall of a building, said panel assembly comprising: a) a rigid back board having opposite inner face and outer face, said back board outer face for anchoring engagement with the building external wall; b) a waterproofing membrane, applied against said back board inner face; c) an air ventilating screen having opposite inner face and outer face, said screen inner face applied against said waterproofing membrane opposite said back board; d) a plurality of shingle members, disposed against said screen outer face in slopewisely cascading fashion; and e) anchor means, fixedly anchoring said waterproofing membrane and said ventilating screen to said back board and to each of said shingle members; wherein said panel assembly is manufactured in factory before installation on the building.

Said shingle members could each be bevelled, having a length, a width, and a thickness tapering lengthwisely thereof from a thick lower end portion to a thin upper end portion, said shingle members defining: a) first shingle members, disposed colinearly along their width in a first coplanar row; b) second shingle members, each of a length similar to that of said first shingle members and disposed colinearly along their width in a second coplanar row, with said first shingle members upper end portion being overlappingly taken in sandwich between said second shingle members lower end portion and said air ventilating screen; c) third shingle members, each of a size similar to said first shingle members thin upper end portion and disposed in a third coplanar row, said third shingle members overlappingly taken in sandwich between said first shingle members thick lower end portion and said screen; and d) fourth shingle members, each of a size similar to said first shingle members thicker lower end portion and disposed in a fourth coplanar row, said second shingle members thin upper end portion being overlappingly taken in sandwich between said fourth shingle members and said screen; wherein said coplanar rows are offset from one another; and wherein said fourth shingle members, said first shingles members thick lower end portion and said second shingles thick lower end portion each define an exterior exposed face. Each successive pair of said shingle members from a given one of said coplanar rows, could then define a small keyway gap (preferably 1 to 5 mm) therebetween, each said gap from one row of said shingle members being transversely offset from any of said gap from an adjacent row of said shingle members.

The above-noted panel assembly could be in combination with a second said panel assembly similar to the first mentioned panel assembly, and each of said second panel assembly and first mentioned panel assembly further including complementary first and second interlocking edgewise joint means, edgewisely interlocking said second panel assembly with said first-mentioned panel assembly in a generally coplanar fashion, wherein said shingle members of both said first mentioned panel assembly and said second panel assembly, remain generally parallel in slopewise fashion.

Preferably, said air ventilating screen consists of a nylon mesh screen. This nylon mesh could define a wavy configuration forming open slopewise channels for evacuation of moisture. The thickness of said nylon mesh could range between about 5 to 25 mm. Said anchor means could include a plurality of rust resistant staples, at least two driven through each of said shingle members and through said back board, said waterproofing membrane, and said air ventilating screen, and for anchoring to the building side wall. Moreover, said staples could anchor said first and second shingle members, and are driven through an intermediate section of the length thereof, wherein the latter staples are concealed from outside view and shielded from weathering elements by said fourth shingle members and said second shingle members lower end portion.

Preferably, said back board, said waterproofing membrane, said air ventilating screen and edgewise said shingle members that extend along the edges of said panel assembly, form a peripheral edge, said peripheral edge including a joint portion, said joint portion for engagement with another similar second joint portion from a second said panel assembly for forming generally coplanar interlocking joint means between the first mentioned panel assembly with said second panel assembly.

Preferably, there is provided weathertight lip means, integral to said edgewise shingle members for shielding and concealing the interlocking joint means formed by the joined first mentioned joint portion and said second joint portion. Each of said joint portion could then be double-bevelled.

The invention also relates to a method of mounting a first such shingles panel assembly and a second such shingles panel assembly against a building external wall, wherein said method comprises the following steps:

a) applying and anchoring said first shingles panel assembly back board against the building external wall;

b) applying said second shingles panel assembly against the building external wall proximate said first shingles panel assembly;

c) slidingly bringing a first said joint portion of said first shingles panel assembly against a second said joint portion of said second shingles panel assembly; and c) edgewisely interlocking said first joint portion and said second joint portion in weathertight fashion.

This method could also include the following mounting step, concurrent with said step d):

overlapping registering integral lip portions of said shingle members from said first shingles panel assembly over said first joint portion and said second joint portion during said edgewisely interlocking.

The invention also relates to a modular unit for use as a building side wall covering, said modular unit comprising: a) a unitary rigid sheet backing; b) a unitary flexible air ventilating mesh; c) a unitary flexible hydrophobic membrane, taken in sandwich between said mesh and said backing and defining an outer face; d) a number of discrete fluid screens, applied against said membrane outer face opposite said hydrophobic membrane; and e) anchoring means anchoring said screens to said membrane, mesh and backing, wherein said screens form a unitary first fluid shield transversely spaced from said hydrophobic membrane forming a unitary second fluid shield.

Said discrete fluid screens could then include at least two slopingly cascading rows of said screens, each pair of successive screens from a given one of said rows being spaced from one another by a keyway slot, each of said keyway slot being offset from a corresponding keyway slot from one adjacent of said screens from an adjacent one of said rows. Said fluid screens could also include a first row of first shingles, a second row of second shingles, and at least a third row of third shingles, said first shingles being about half the size of the remaining said shingles, said second shingles having a half portion concealed by said first shingles, and said third shingles having a half portion concealed by said second shingles. Said air ventilating mesh may be a nylon mesh of about 5 to 25 mm in thickness, said mesh ondulating so as to define sloping grooves, said grooves providing slopewise moisture escape between said discrete fluid screens and said hydrophobic membrane.

DETAILED DESCRIPTION OF THE PREFERRED EMBODIMENT OF THE INVENTION

Figure 1:
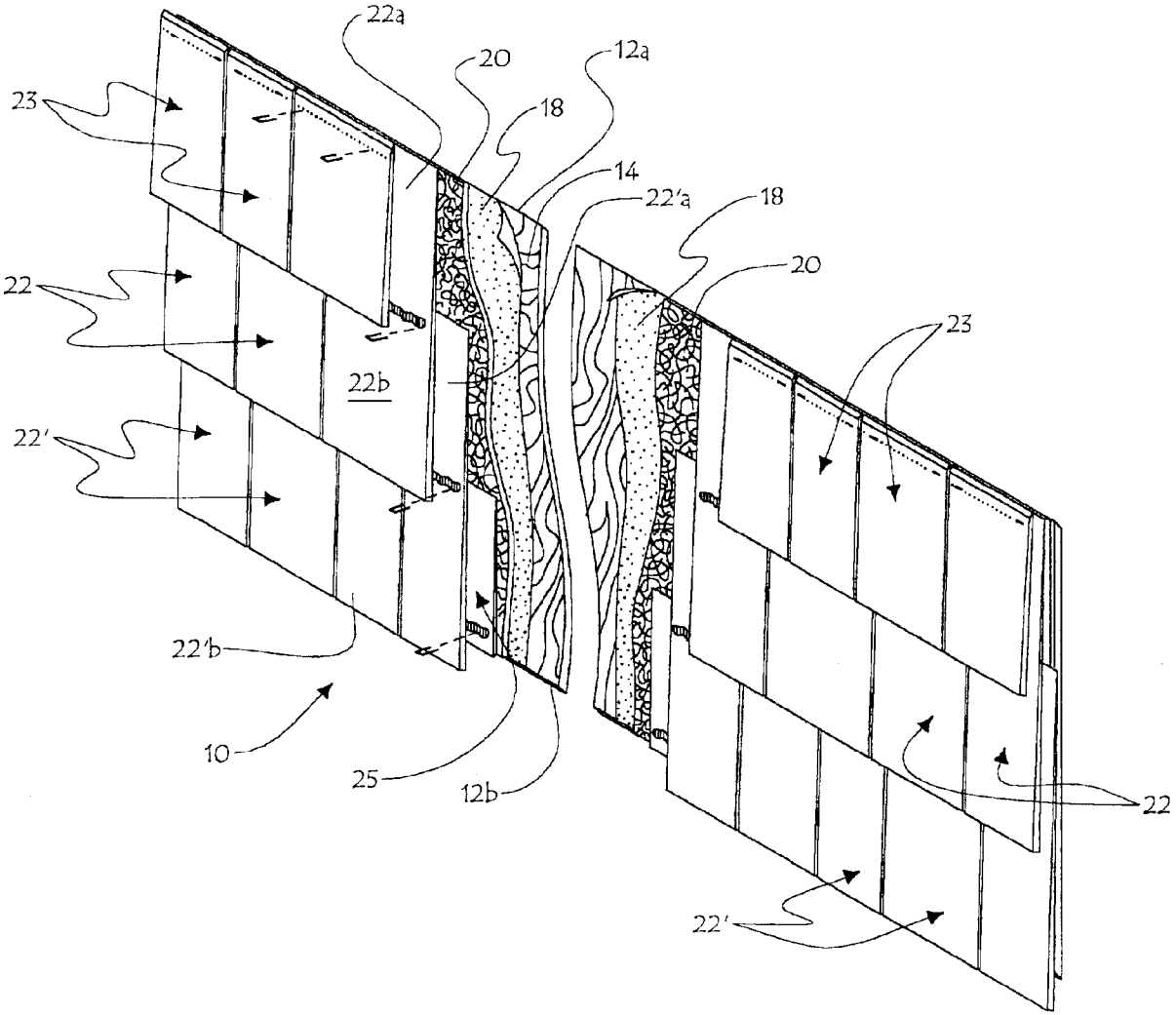
FIG. 1 is a partly broken perspective view of an assembly of plywood board and shingles according to a preferred embodiment of the invention, showing the various layered components thereof.
Figure 2:
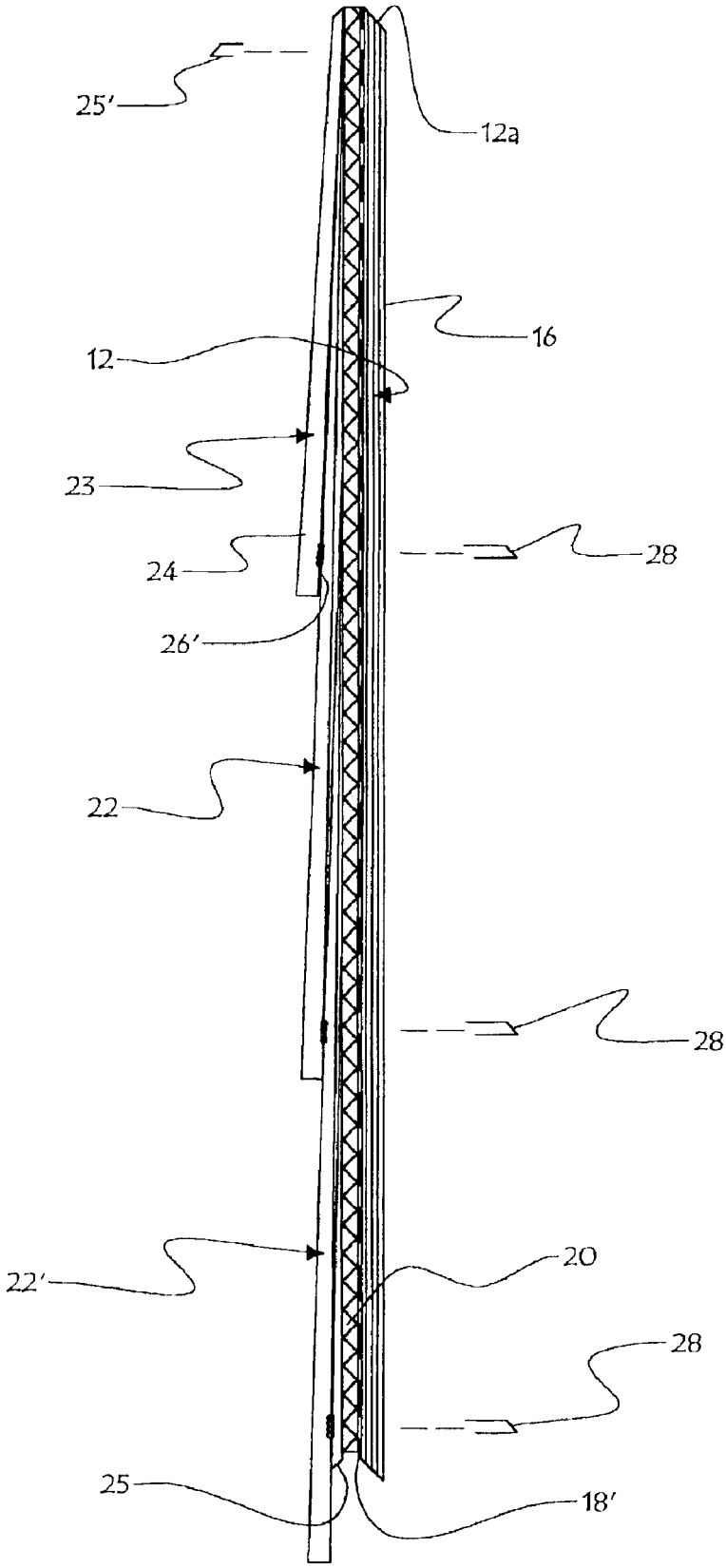
FIG. 2 is a vertical sectional view, at an enlarged scale, of the plywood board and shingles assembly of FIG. 1.

The assembly of board and shingles, 10 (FIGS. 1–2 and 4), or second assembly 110 (see FIGS. 3*a*–3*b* and 4 with corresponding references in the one hundred series) includes a continuous rigid sheet backer, for example a plywood board 12. Board 12 defines an inner face 14, an outer face 16, and a peripheral edge including a top edge 12A and a bottom edge 12B. Edges 12A, 12B, are preferably bevelled. Plywood board 12 may have, for example, a thickness of 1 centimeter (cm), a length of 250 cm and a width of 50 cm. A second sheet 18, forming a continuous water barrier membrane, for example a flexible perforated asphalt felt, is applied against the inner face 14 of board 12. Water barrier membrane 18 forms a continuous sheet, which may be approximately the same size in length as well as in width as the plywood backing board 12, to provide optimum moisture protection for the plywood board 12. A third sheet 20, forming a ventilating and self draining rainscreen membrane, for example a flexible nylon mesh, is applied against the asphalt felt sheet 18.

A series of shingles 22, 22', 23, 25, is provided to abut against the nylon mesh 20. Shingles 22 may be rigid wooden panels, for example of square shape having a side of about 22 cm for the exposed face (i.e. much smaller than board 12). Each shingle 22 may be made from wood, e.g. from cedar wood. As suggested in FIG. 1, a number of shingles could be provided against a single plywood board 12, in slopewisely (downwardly) cascading offset, for example three vertically spaced horizontal rows of a number of shingles.

Full length bevelled shingles 22 form an upper first row, with the thinner upper half portion thereof 22A abutting directly against screen 20 and extending up to the top peripheral edge portion 12A of board 12. Full length bevelled shingles 22' form a lower second row, with the thinner upper half portion thereof 22'A being taken in sandwich between the screen 20 and the thicker half portion 22B of upper bevelled shingles 22, and extending down to bottom edge 12B. Smaller size thicker shingles 23 form a third exposed upper row, being applied against the outer face of the thinner upper portion 22A of upper full length shingles 22 opposite screen 20. Other smaller size thinner shingle 25 form a fourth concealed lower row, being taken in sandwich between screen 20 and the thicker lower end portion 22'B of full length shingles 22'. Thicker shingles 23 and thinner shingles 25 may be made for example from two different respective halves of the stock of full length shingles used for the rows of shingles 22 or 22'.

Preferably, each successive pair of shingles in one row is spaced by a narrow gap 32, e.g. a 1 to 5 mm gap for handling expansion or contraction from moisture or temperature loads. These gaps 32 form natural keyway appearance, providing more efficient water run-off with authentic-look shingle lay-up.

Figures 4, 5, 6:
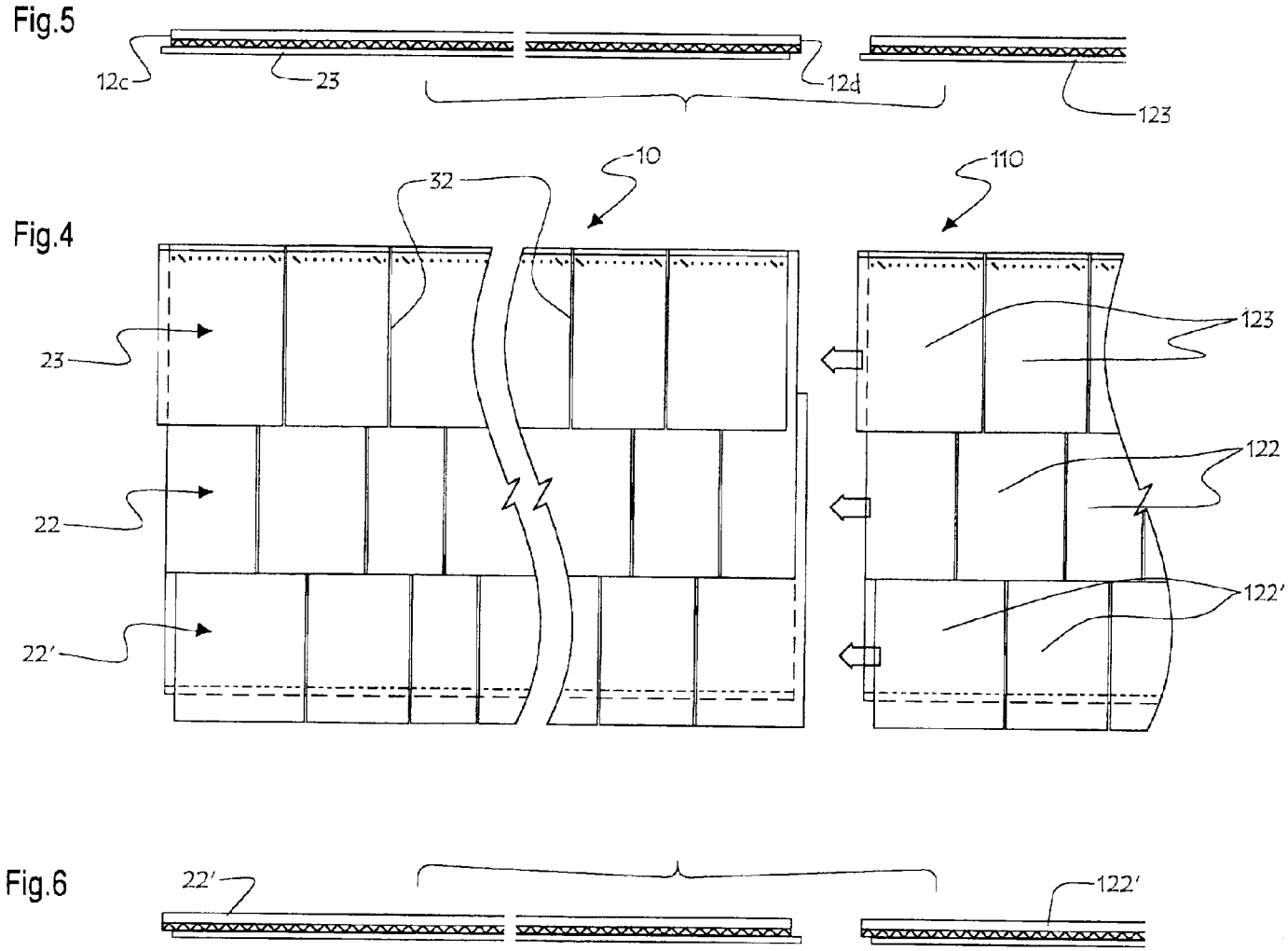
FIG. 4 is a plan view of a pair of plywood board and shingles assemblies of FIGS. 3*a*–3*b*, suggesting with the bold arrows how they can be laterally edgewisely interconnected.
FIGS. 5 and 6 are top and bottom edge views respectively of the components of FIG. 4.
Figure 7:
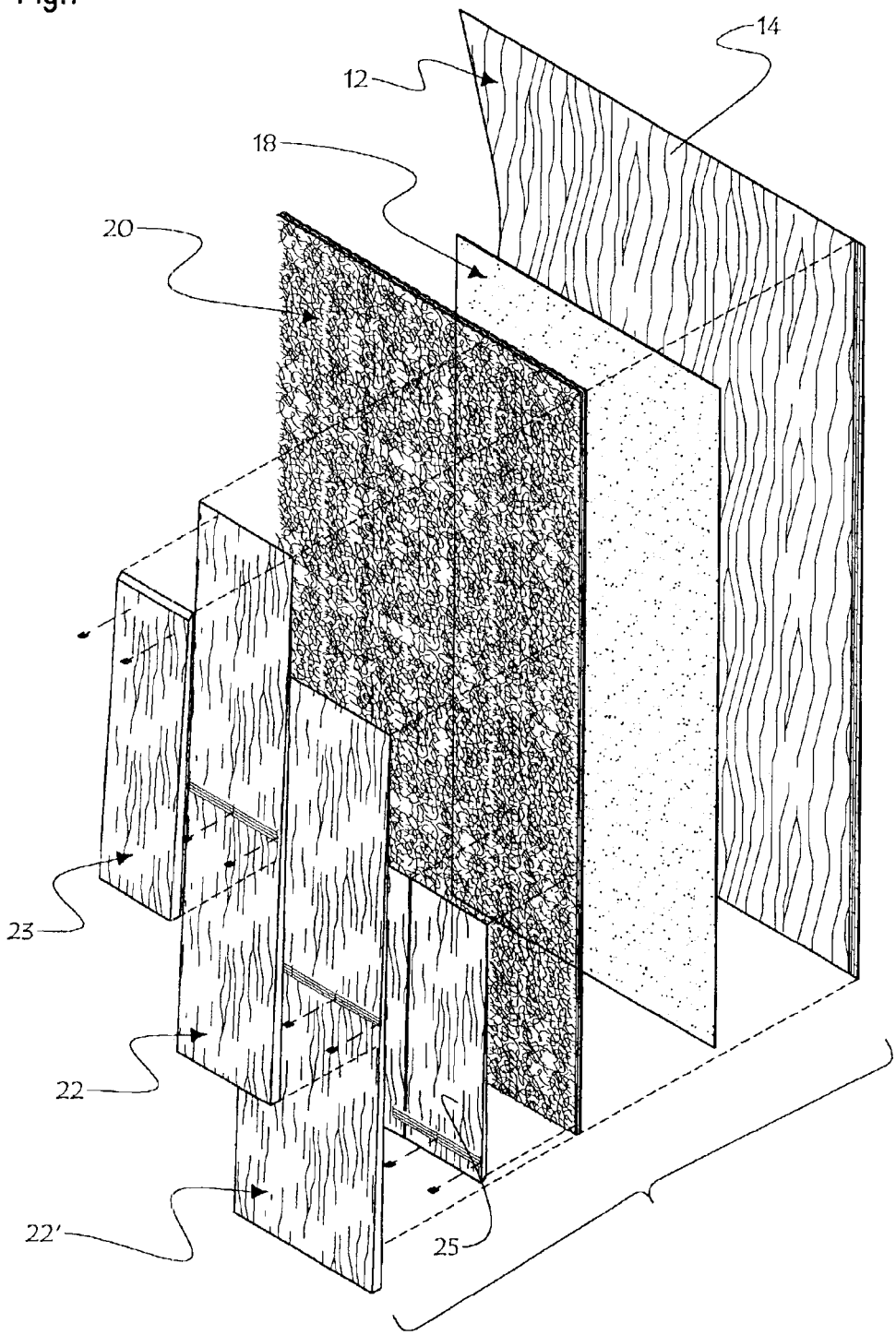
FIG. 7 is an exploded view of part of the plywood board and shingles assembly of FIG. 1.

As best shown in FIG. 4, the intermediate row of full length shingles 22 is horizontally laterally offset, or "step offset", for example by between 1 and 2 cm from both the upper row of straight butted shingles 23 and the lower row of full length undercourse shingles 22'. This step offsetting of the rows of shingles, ensures that the shingle keyways 32 from one row do not come in register with the shingle keyways 32 from the next row, so that a continuous albeit irregular shingle surface be present over the full of the panel assembly 10. Such a continuous (even if irregular) shingle surface in turn provides a first line of defense against water infiltration and thus better waterproofness of panel assembly 10.

Each shingle, e.g. shingle 22, forms an elongated bevelled panel lengthwisely tapering in thickness, defining an exterior face and an opposite inner face, and also defining a lower thicker edge portion 22B (22'B) tapering into a thinner upper edge portion 22A (22'A). Each shingle 22, 22', further defines a peripheral edge 26A, being preferably bevelled, wherein, as best shown in FIG. 3*a*, each of the pair of edge portions 12A, 26A (112A, 126A) form a rough square V-shape. Complementary edgewise interlocking of two panel assemblies 10, 110 can thus be achieved by bringing edges 12A, 26A against edges 112A, 126A.

Connector members, for example laterally spaced rust resistant gummed nails or staples 28', fixedly interconnect the top edge portion of shingles 23 with the portion 22A of underlying shingle 22. Furthermore, additional staples 28, 28, fixedly interconnect the thinner upper edge portion 22A of each shingle 22, 22', to the first, second and third sheets 12, 18, and 20, respectively of the assembly 10 and to a support wall surface W (FIGS. 3*a*–3*b*) against which is to be applied the plywood board 12.

Nails 28 should be of sufficient length to penetrate wall W sufficiently to provide enough anchoring, for example by about 1.5 cm. Wall surface W is for example the exposed exterior face of the wooden planar frame of a house vertical side wall.

As suggested in FIG. 3*a* of the drawings, the board and shingle assembly 10 has at its lateral side ends overlapping means which, together with interlocking means 26A, 12A/126A, 112A, provide all vertical seams between two successive shingles from a same horizontal row, with weather-tight lap. These overlapping means consists of a lateral edgewise extension of each shingle 23 and shingle part 22B, 22'B, in one direction substantially beyond the underlying shingle part 22A, 22'A, 25. Since, as illustrated in FIG. 3A, shingle part 122 is thinner than shingle 123, shingle 23 will be able to clear facing edge 126A of shingle 122 and slide against (FIG. 3*b*) the exposed outer face of shingle 122, wherein the interlocking edge joint between membranes 12, 18, 20 and shingle 22 and membranes 112, 118, 120, and shingle 122 will be shielded against weathering agents, and concealed from apparent view by the extension lip 23A of overlying shingle 23. Nails 28 will also be concurrently shielded and concealed by shingle extension lip 23A. The shingle extension lip 23A may have a length of for example 4 cm.

It is noted that all anchoring staples 28 of the shingles become concealed by the lower edge portion of the next uppermost row shingles, except that the staples 28' that anchor the top edge portion of top shingles 23. It is therefore understood that installation of the shingles over sheets 12, 18, and 20 is a bottom up operation, i.e. starting with the lowermost horizontal row of shingles 25, then the lower full length shingles 22', to conceal lowermost shingles 25, then upper full length shingles 22, and building up finally toward the uppermost horizontal row of exposed shingles 23 as the last laid row of shingles.

Obviously, there could be more than three apparent rows of shingles in a given panel assembly 10, or alternately, only two (shingles 22 and 23, with concealed shingles 25 placed beneath shingles 22).

A line of glue compound, such as a polyurethane adhesive compound for exterior use, is preferably applied against the exterior face of the lower thicker edge portion of each shingle, for stabilizing engagement with the exterior surface of an upper shingle and with the interior surface of a lower shingle, in between each pair of successive rows, to cover the external heads 28A of the staples 28, as well as to prevent accidental tilt of the shingles relative to one another under weathering forces. Hence, the glue and staples hold the shingles firmly, yet allow them to move so contraction or expansion is not transferred to the plywood backer 12. Moreover, the glue effectiveness is much improved, since the glue engages wood surface with wood surface from two different shingles, instead of the prior art weaker engagement between two different materials (a water barrier membrane and a shingle wall).

Figure 3B:
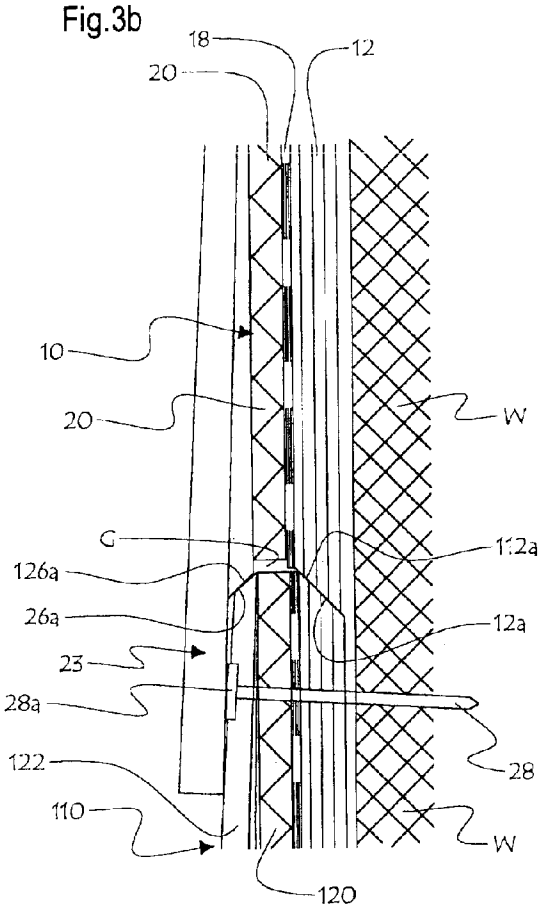
FIGS. 3*a* and 3*b* are enlarged horizontal sectional views of facing edge portions of two adjacent assemblies of board and shingles, sequentially showing how both assemblies can become edgewisely interlocked in weathertight fashion.
Figure 3A:
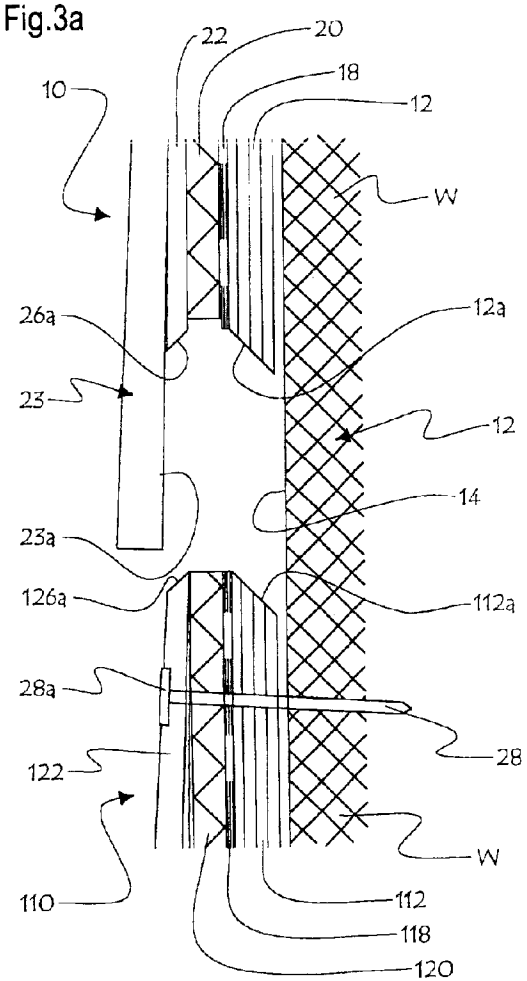

Preferably, and as illustrated in FIG. 3*b*, a vertical gap G is formed between the lateral edges of the nylon mesh 20, 120. Gap G forms a moisture evacuation channel.

The air spacing membrane 20 is preferably made from a flexible nylon mesh, for example those manufactured under the trademarks HOME SLICKER or CEDAR BREATHER (manufacturer: Benjamin Obdyke, Horsham, Pa.). The thickness of the nylon mesh 20 may range for example between 5 to 25 millimeters (mm). This open mesh membrane 20 forms an underlayment for the wood shingles 22, and provides space for a continuous air flow between the solid sidewall W and the shingles. Hence, the entire underside of the shingle will be able to dry uniformly after rain, thus providing pressure equalization and eliminating excess moisture through integral drainage channels. A thermal break is thus obtained, for preventing thermal cupping and warping, while reducing potential rotting in particular of sidewalls material.

Preferably, the whole nylon mesh 20 is wavy, i.e. of sinusoidal pattern, so that slopewise water channels are formed for the escape of moisture trapped between the shingles 22 and the water barrier membrane 18. Indeed, thanks to the nylon mesh sheet 20, since there is no direct contact between the shingles 22 and the asphalt barrier sheet 18, thus no negative pressure is generated that would undesirably trap moisture therebetween and suck same inside of the building. Accordingly, at least the plywood backing board 12 and the shingles 22 (22', . . . ) are much less threatened by the build-up of moisture that occurred in prior art sidewall shingles systems, and thus their useful life expectancy is increased.

Instead of a nylon mesh, a metallic mesh is not excluded as a material for the air spacing sheet 20, but expensive rust proofing treatment thereof would be a prerequisite for long lasting use. An open wooden lattice is also not excluded for material of sheet 20, but the unevenness of the surface thereof could create some problems during installation. A high density polyethylene membrane with conical embossment network could also be used for the sheet 20, for example the damp-proofing membrane sold under the trademark DORKEN DELTA-MS/MS-20 (manufacturer: Consella Products Ltd., Hamilton, Ontario), but this membrane is a bit too rigid and too water-tight which would undesirably substantially prevent egress of infiltrated water and moisture from the inside of the building.

For the water barrier membrane 18, perforated asphalt paper is preferred, for example a 7 kilograms (kg) grade asphalt paper sheet, since it does prevent inward water seeping from outside, while enabling trapped moisture to escape toward the outside. Other exterior wall waterproofing membranes could also be used, for example the membrane known under the TYVEK trademark (manufacturer: Dupont Canada, Mississauga, Ontario). Due to the specific assembly method of the present shingle assembly 10, it is understood that there are provided two separate and effective water barriers:

a) the water barrier sheet 18; and b) the shingles 22 themselves.

With the present invention, it has been found that, unexpectedly, the useful lifetime of the shingle assembly 10, 110, would be extended by between 40 to 60%, compared to prior art shingle assemblies, and depending upon the climatic conditions of the specific area where the building is constructed. Accordingly, the present shingle assembly 10, 110, . . . should remain stable and "as new" for at least 12 to 15 years of use.

The present invention is well suited for improving residential sidewall ventilation, but can extend also to the non-residential building sector as well. It is designed to meet the needs of the construction industry, not only for sidewalls but also for any other wall surface which could be exposed to weathering forces, for example roofing.

We claim:

1. An exterior weather shielding panel assembly for fitting against an external wall of a building, said panel assembly comprising:

a) a rigid back board having opposite inner face and outer face, said back board outer face for anchoring engagement with the building external wall;

b) a waterproofing membrane, applied against said back board inner face;

c) an air ventilating screen having opposite inner face and outer face, said screen inner face applied against said waterproofing membrane opposite said back board;

d) a plurality of shingle members, disposed against said screen outer face in slopewisely cascading fashion; and e) anchor means, fixedly anchoring said waterproofing membrane and said ventilating screen to said back board and to each of said shingle members;

wherein said panel assembly is manufactured in factory before installation on the building.

2. A panel assembly as in claim 1, wherein said shingle members each are bevelled, having a length, a width, and a thickness tapering lengthwisely thereof from a thick lower end portion to a thin upper end portion, said shingle members defining:

a) first shingle members, disposed colinearly along their width in a first coplanar row;

b) second shingle members, each of a length similar to that of said first shingle members and disposed colinearly along their width in a second coplanar row, with said first shingle members upper end portion being overlappingly taken in sandwich between said second shingle members lower end portion and said air ventilating screen;

c) third shingle members, each of a size similar to said first shingle members thin upper end portion and disposed in a third coplanar row, said third shingle members overlappingly taken in sandwich between said first shingle members thick lower end portion and said screen; and d) fourth shingle members, each of a size similar to said first shingle members thickn lower end portion and disposed in a fourth coplanar row, said second shingle members thin upper end portion being overlappingly taken in sandwich between said fourth shingle members and said screen;

wherein said coplanar rows are offset from one another; and wherein said fourth shingle members, said first shingles members thick lower end portion and said second shingles thick lower end portion each define an exterior exposed face.

3. A panel assembly as in claim 2, wherein each successive pair of said shingle members from a given one of said coplanar rows, define a small keyway gap therebetween, each said gap from one row of said shingle members being transversely offset from any of said gap from an adjacent row of said shingle members.

4. A panel assembly as in claim 3, wherein said offset between one said gap and another said gap from an adjacent row, is in the centimeter range, while said keyway gap is in the millimeter range.

5. A panel assembly as in claim 2, in combination with a second said panel assembly similar to the first mentioned panel assembly, and each of said second panel assembly and first mentioned panel assembly further including complementary first and second interlocking edgewise joint means, edgewisely interlocking said second panel assembly with said first-mentioned panel assembly in a generally coplanar fashion, wherein said shingle members of both said first mentioned panel assembly and said second panel assembly, remain generally parallel in slopewise fashion.

6. A panel assembly as in claim 5, further including a moisture escape gap, formed edgewisely between said screen of each of the first mentioned panel assembly and of said second panel assembly.

7. A panel assembly as in claim 2, wherein said anchor means includes a plurality of rust resistant staples, at least two driven through each of said shingle members and through said back board, said waterproofing membrane, and said air ventilating screen, and for anchoring to the building side wall.

8. A panel assembly as in claim 7, wherein said staples anchoring said first and second shingle members, are driven through an intermediate section of the length thereof, wherein the latter staples are concealed from outside view and shielded from weathering elements by said fourth shingle members and said second shingle members lower end portion.

9. A panel assembly as in claim 2, wherein said back board, said waterproofing membrane, said air ventilating screen and edgewise said shingle members that extend along the edges of said panel assembly, form a peripheral edge, said peripheral edge including a joint portion, said joint portion for engagement with another similar second joint portion from a second said panel assembly for forming generally coplanar interlocking joint means between the first mentioned panel assembly with said second panel assembly.

10. A panel assembly as in claim 9, further including weathertight lip means, integral to said edgewise shingle members for shielding and concealing the interlocking joint means formed by the joined first mentioned joint portion and said second joint portion.

11. A panel assembly as in claim 10, wherein each of said joint portion is double-bevelled.

12. A panel assembly as in claim 1, wherein said air ventilating screen consists of a nylon mesh screen.

13. A panel assembly as in claim 12, wherein said nylon mesh defines a wavy configuration forming open slopewise channels for evacuation of moisture.

14. A panel assembly as in claim 12, wherein the thickness of said nylon mesh ranges between about 5 to 25 mm.

15. A method of mounting a first shingles panel assembly and a second shingles panel assembly against a building external wall, each of said first panel assembly and second panel assembly comprising:

a rigid back board having opposite inner face and outer face, said back board outer face for anchoring engagement with the building external wall;

a waterproofing membrane, applied against said back board inner face;

an air ventilating screen having opposite inner face and outer face, said screen inner face applied against said waterproofing membrane opposite said back board;

a plurality of shingle members, disposed against said screen outer face in slopewisely cascading fashion, and including a number of edgewise shingle members, wherein said back board, said waterproofing membrane, said air ventilating screen and said edgewise shingle members together form a peripheral edge, and said peripheral edge including a joint portion; and anchor means, fixedly anchoring said waterproofing membrane and said ventilating screen to said back board and to each of said shingle members;

wherein said method comprises the following steps:

a) applying and anchoring said first shingles panel assembly back board against the building external wall;

b) applying said second shingles panel assembly against the building external wall proximate said first shingles panel assembly;

c) slidingly bringing a first said joint portion of said first shingles panel assembly against a second said joint portion of said second shingles panel assembly; and d) edgewisely interlocking said first joint portion and said second joint portion in weathertight fashion.

16. A method of mounting as in claim 15, further including the following mounting step, concurrent with said step d): overlapping registering integral lip portions of said shingle members from said first shingles panel assembly over said first joint portion and said second joint portion during said edgewisely interlocking.

17. A modular unit for use as a building side wall covering, said modular unit comprising:

a) a unitary rigid sheet backing;

b) a unitary flexible air ventilating mesh;

c) a unitary flexible hydrophobic membrane, taken in sandwich between said mesh and said backing and defining an outer face;

d) a number of discrete fluid screens, applied against said membrane outer face opposite said hydrophobic membrane; and e) anchoring means anchoring said screens to said membrane, mesh and backing, wherein said screens form a unitary first fluid shield transversely spaced from said hydrophobic membrane forming a unitary second fluid shield.

18. A modular unit as in claim 17, wherein said discrete fluid screens include at least two slopingly cascading rows of said screens, each pair of successive screens from a given one of said rows being spaced from one another by a keyway slot, each of said keyway slot being offset from a corresponding keyway slot from one adjacent of said screens from an adjacent one of said rows.

19. A modular unit as in claim 18, wherein said fluid screens include a first row of first shingles, a second row of second shingles, and at least a third row of third shingles, said first shingles being about half the size of the remaining said shingles, said second shingles having a half portion concealed by said first shingles, and said third shingles having a half portion concealed by said second shingles.

20. A modular unit as in claim 19, wherein said air ventilating mesh is a nylon mesh of about 5 to 25 mm in thickness, said mesh ondulating so as to define sloping grooves, said grooves providing slopewise moisture escape between said discrete fluid screens and said hydrophobic membrane.

* * * * *